United States Patent [19]

Passoni

[11] 4,158,954

[45] Jun. 26, 1979

[54] EXTRACTION DEVICE FOR CONTINUOUS ROLLING MILLS USING A RETAINED MANDREL

[75] Inventor: Teresio Passoni, Magenta, Italy

[73] Assignee: Innocenti Santeustacchio S.p.A., Brescia, Italy

[21] Appl. No.: 878,440

[22] Filed: Feb. 16, 1978

[30] Foreign Application Priority Data

Mar. 16, 1977 [IT] Italy ..... 21304 A/77

[51] Int. Cl.[2] ..... B21B 25/00

[52] U.S. Cl. ..... 72/209; 72/250

[58] Field of Search ..... 72/208, 209, 245, 250, 72/97, 251, 238, 239

[56] References Cited

U.S. PATENT DOCUMENTS 2,214,279 9/1940 Kocks ..... 72/209

3,277,687 10/1966 Kelly ..... 72/209

3,392,565 7/1968 Rodder ..... 72/209 X

*Primary Examiner*—Milton S. Mehr

*Attorney, Agent, or Firm*—Birch, Stewart, Kolasch & Birch

[57] ABSTRACT

The present invention is directed to an extraction device for use in continuous rolling mills for extracting tubes from retaining mandrels. The extraction device includes a frame having three pressure yielding rollers mounted therein. The rollers are normally retained in a fixed position for performing a final reduction on the tubes. However, if a mandrel on which the tube has been rolled accidentally enters the orifice defined by the three rollers, the rollers will yield to the excessive pressure and move away from the center of the frame by an amount corresponding to the maximum diameter of the tube containing the mandrel.

2 Claims, 3 Drawing Figures

EXTRACTION DEVICE FOR CONTINUOUS ROLLING MILLS USING A RETAINED MANDREL

BACKGROUND OF THE INVENTION

1. Field of the Invention

The invention relates to an extraction device for continuous rolling mills using a retained mandrel. The device substantially comprises at least one rolling frame having three pressure yielding rollers.

2. Description of the Prior Art

When pipes are produced by continuous rolling in rolling-mills using a prior-art retained mandrel a device for extracting the end of each pipe from the tip of the mandrel after the rolling operation is completed has to be placed downstream of the rolling train.

An extraction device widely used at present for the aforementioned purpose comprises a number of three-roller frames which are constructed substantially as a calibrator in order to finish the rolled tubes at the same time as the tubes are extracted.

The rollers in the frames of the aforementioned devices are used for simultaneous extraction and calibration, which means that the rollers perform a reduction operation on each manufactured pipe. In order to perform such reduction work on thin or medium-thickness tubes, the diameter of the orifice defined by the three rollers of each frame in the extraction device must be less than the diameter of the mandrel used in the rolling-mill.

It is known that during the operation of a continuous rolling-mill comprising a retained mandrel, the mandrel may accidentally be disengaged from the securing device, with the result that the mandrel and the rolled pipe therein may move downwards through the entire rolling-mill. When the pipe and mandrel secured thereto enter the first roller frame in the extraction device, they meet an orifice which, as already stated, has a diameter less than the mandrel diameter.

The above-discussed occurrence inevitably results in serious damage to the rollers and/or the associated mechanical parts, which will necessitate prolonged stoppage of the entire plant and replacement of one or more damaged frames, resulting in damage and economic losses.

SUMMARY AND OBJECTS OF THE INVENTION

The present invention is directed to a device for safely extracting a tube from the tip of a mandrel downstream of continuous rolling mills using a retained mandrel. The device of the present invention has structural and functional characteristics such as to completely eliminate the aforementioned serious disadvantage of the prior art. The device of the present invention is also designed so as to extract the pipe in a desired manner and simultaneously calibrate it so as to obtain a finished rolled pipe.

To this end, according to the present invention, the rollers are held in the operative position by corresponding pressure means secured by the rolling frame, each pressure means being adapted to yield resiliently in a substantially radial direction relative to the orifice in the event of a pressure greater than a given predetermined value exerted on a corresponding roller from inside the orifice.

The main advantage of the present invention is that if a pipe and the mandrel on which the pipe has been rolled accidentally enter the orifice defined by the rollers in the frame and subject the rollers to a radial load greater than a predetermined value, the rollers can move away from the center of the frame by an amount corresponding to the maximum diameter of the pipe containing the mandrel. Thus, the present invention completely eliminates any damage to the rollers in the frame and/or to the mechanical parts associated with the rollers.

Other objects and further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
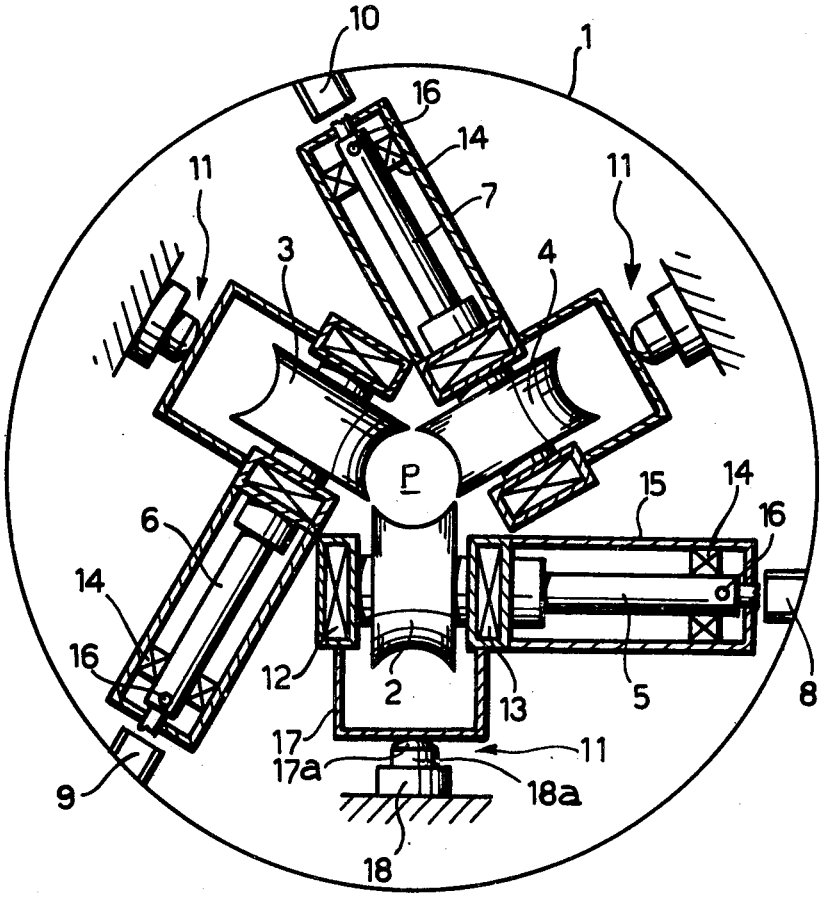
FIG. 1 is a diagram of a frame comprising three rollers forming a device according to the present invention.

The drawings diagrammatically show a frame 1 comprising three rollers. The frame need not be described in detail since its structure is substantially similar to the conventional structure of a rolling frame which comprises three rollers in a reducing rolling mill. An extraction device according to the present invention comprises one or more frames 1 disposed in line and at angles of 60° to one another. Frame 1 comprises three identical rollers 2, 3, 4 defining a circular orifice P having a preset diameter in accordance with the simultaneous extraction and calibration (or reduction) operations which are to be performed on a pipe discharged from a continuous rolling mill comprising a retained mandrel.

Rollers 2, 3, 4 are coaxially mounted on mechanically driven shafts 5, 6, 7 respectively, disposed with their axes in the same plane and at angles of 120° to each other. Three diagrammatically indicated connections 8, 9, 10 transmit the required mechanical power to shafts 5, 6 and 7.

A pressure means (general reference 11) holds each roller 2, 3, 4 in an operative position in which the rollers define the aforementioned orifice P. Since the three rollers are identical and all are similarly positioned within the frame 1 according to the present invention, the following description will be simplified by being restricted to the roller 2 and its associated pressure means 11 only.

Shaft 5 of roller 2 is coaxially and rotatably positioned by the interpositioning of the bearings 12, 13 and 14, in a tubular arm 15 which is held in substantially overhanging relationship by the bearing structure of frame 1 via hinge means diagrammatically indicated at 16, 16 having their axes parallel to the axis of orifice P.

A substantially straddling or spanning member 17 is perpendicularly secured to arm 15 at the boxes for bearings 12, 13 defined by it. Member 17 extends in overhanging relationship from the arm, from the side thereof remote from the side facing orifice P.

Member 17 bears against the free rounded end 17*a* of the rod 18*a* of a fluid dynamic cylinder 18, e.g. a hydraulic cylinder, loaded at a given fluid pressure. Cylinder 18 is permanently secured to the structure bearing frame 1 and extends with its axis perpendicular to the axis of orifice P and coinciding with an axis of symmetry of the corresponding roller 2. Cylinder 18 is connected to a source (not shown) of pressure fluid and is equipped in a conventional manner with an overload relief valve.

The fixed pressure within the cylinders 18 is considerably greater than the pressure exerted on rollers 2, 3 and 4 by a pipe travelling through orifice P during the desired extraction and calibration (or reducing) operations. Therefore, the rollers 2, 3 and 4 are securely and permanently held in the operative position by the respective cylinders.

If a pipe together with a mandrel accidentally travels through the frame, then, since the diameter of orifice P is less than the mandrel diameter, the radial load on rollers 2, 3, 4 increases considerably and easily overcomes the opposing pressure exerted on the rollers by means of the corresponding cylinders 18. This pressure difference is sufficient to retract pistons 18*a* instantaneously into cylinders 18, so that the tubular arms 15 and consequently the associated rollers can move through an angle around the axes 16 at which the arms are pivoted to frame 1. As a result, there is an instantaneous increase in the area of orifice P, which completely eliminates serious damage to the rollers and/or the associated mechanical parts, such as would occur if the area remained constant, as in the case of prior-art frames in extraction devices.

Figure 2:
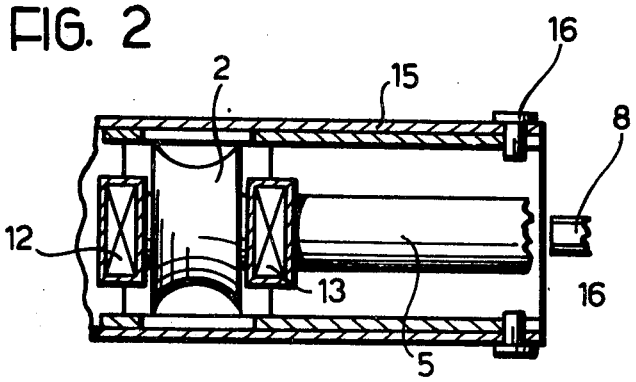
FIG. 2 is a diagrammatic plan view on a larger scale of a structural feature of the frame illustrated in FIG. 1.
Figure 3:
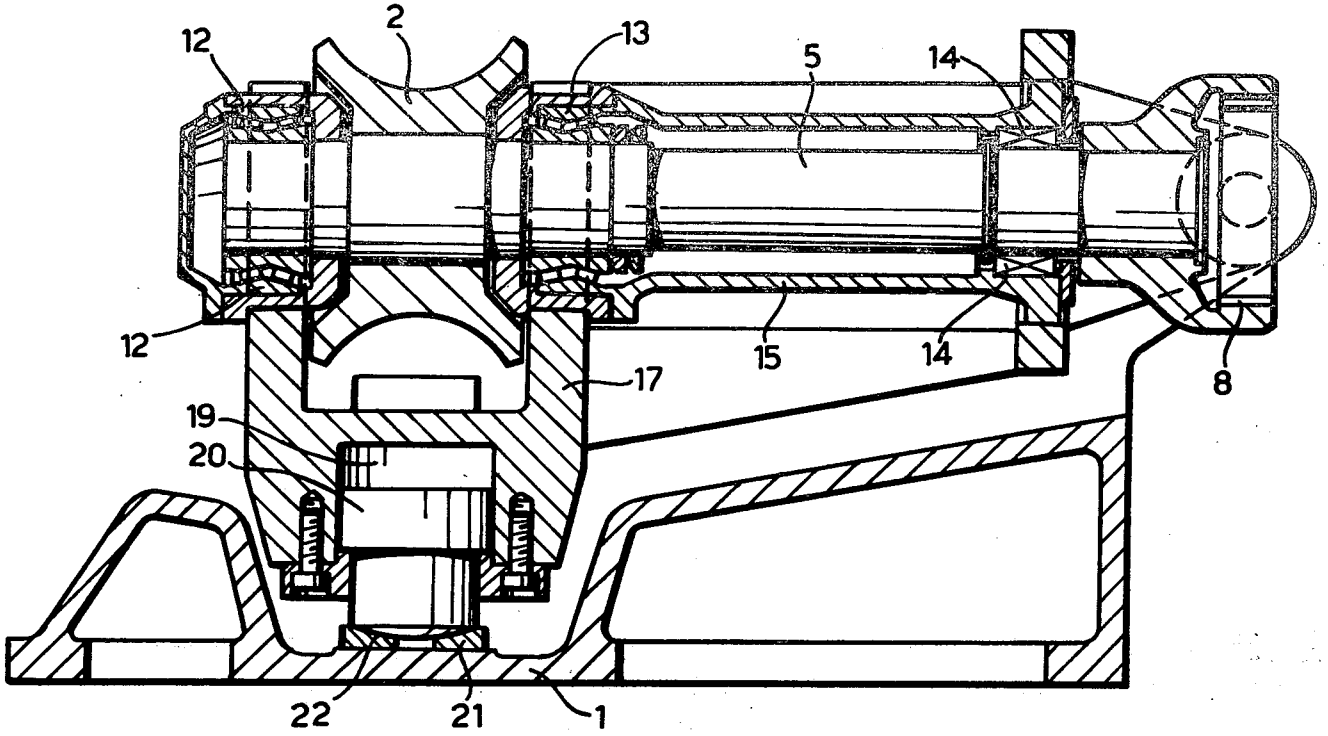
FIG. 3 is a large-scale view of another embodiment of a feature of the present invention as illustrated in FIG. 1.

FIG. 3 shows an embodiment of an arm 15 and an associated straddling member 17. In FIG. 3, components similar to those described with reference to the diagrams in FIGS. 1 and 2 bear similar reference numbers. In the embodiment in FIG. 3, the spanning or straddling member 17 is formed with a cylindrical chamber 19 loaded with fluid at a given pressure and in sliding engagement with a piston 20 having a rod 22 borne by the structure bearing the frame 1, via a connection substantially comprising a spherical pivot 21.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. An extraction device for continuous rolling mills comprising:

a retained mandrel and at least one rolling frame having three rollers defining an orifice for a tube to be extracted from the mandrel;

said rollers being held in the operative position by corresponding pressure means secured by the rolling frame;

said pressure means being adapted to yield resiliently in a substantially radial direction relative to the orifice in the event of a pressure greater than a predetermined value being exerted on the corresponding roller from inside the orifice.

2. A device according to claim 1 comprising:

a tubular arm inside which a shaft is axially and rotatably borne and keyed to a corresponding roller;

said arm being secured in overhanging relationship by the frame by means of a hinge with its axis parallel to the axis of the orifice;

a substantially spanning member being secured to the arm and extending in overhanging relationship from a portion of the arm opposite a portion facing the orifice;

a cylinder-piston unit being loaded with a working fluid at a given pressure and acts on the spanning member, the axis of the cylinder-piston unit being perpendicular to the axis of the orifice and coinciding with an axis of symmetry of a corresponding roller.

* * * * *